United States Patent [19]

Balko et al.

[11] 4,126,536

[45] Nov. 21, 1978

[54] DIAPHRAGMS FOR CHLOR-ALKALI CELLS

[75] Inventors: Edward N. Balko, Trenton; Shyam D. Argade, Woodhaven; James E. Shrewsburg, Southgate; Douglas A. Porath, Dearborn Heights, all of Mich.

[73] Assignee: BASF Wyandotte Corporation, Wyandotte, Mich.

[21] Appl. No.: 754,655

[22] Filed: Dec. 27, 1976

[51] Int. Cl.[2] ..... C25B 13/08; C25B 1/34

[52] U.S. Cl. ..... 204/296; 204/98

[58] Field of Search ..... 204/296, 295; 428/242, 428/281, 283

[56] References Cited

U.S. PATENT DOCUMENTS

| | | | |
|---|---|---|---|
| 2,788,285 | 4/1957 | Cooke et al. | 428/242 X |
| 3,346,422 | 10/1967 | Berger | 427/115 |
| 3,616,184 | 10/1971 | Katugiri et al. | 428/242 |
| 3,702,267 | 11/1972 | Grot | 429/34 |
| 4,036,729 | 7/1977 | Patil et al. | 204/296 |

FOREIGN PATENT DOCUMENTS

| | | | |
|---|---|---|---|
| 795,724 | 8/1973 | Belgium | 204/296 |

*Primary Examiner*—F.C. Edmundson

*Attorney, Agent, or Firm*—John W. Linkhauer; Bernhard R. Swick; Robert E. Dunn

[57] ABSTRACT

Synthetic-fiber diaphragms are further improved by incorporating in the diaphragm an effective proportion of a suitable inorganic material such as $TiO_2$, $BaSO_4$ or $K_2Ti_8O_{17}$, which is more hydrophilic than the fluoropolymer forming the diaphragm. This is done either by mixing the inorganic material with the resin before it is made into fiber or by supplying sub-micron-sized particles of the inorganic material, during or even after diaphragm formation. A principal benefit is that this lowers the cell voltage which is required during an initial period (up to about 300 hours) of the operation of a chlor-alkali cell provided with such a diaphragm, making it possible to avoid such drawbacks as suffering an initial period of low production or the necessity of providing external cooling to the cell during such an initial period.

5 Claims, No Drawings

DIAPHRAGMS FOR CHLOR-ALKALI CELLS

CROSS-REFERENCE TO RELATED APPLICATION

This application is related in subject matter to the copending application of Edward N. Balko et. al., Ser. No. 742,818, filed Nov. 18, 1976. The disclosure of this application is hereby incorporated in this application by reference.

BACKGROUND OF THE INVENTION

1. Field of the Invention

This invention relates to the operation of chlor-alkali cells having diaphragms made of synthetic fiber and exhibiting adequate service life and adequate performance characteristics. It concerns, in particular, such diaphragms which give, in addition, improved performance during an initial period of operation of a chlor-alkali cell provided with such a diaphragm, and in one aspect, it relates to a method of renewing one cell unit in a group of series-connected cells in a cell room.

2. Description of the Prior Art

The above-mentioned copending application adequately describes the importance to the brine-electrolysis industry of a development whereby a synthetic fibrous material is used to replace asbestos, yet adequate service life and performance characteristics are obtained. It was found, however, that there was need for an improvement in respect to the performance of such synthetic-fiber diaphragms cells during an initial period of operation, of up to about 300 hours. When work was conducted upon laboratory-scale cells provided with such diaphragms, it was observed that during such initial period of operation, a cell voltage higher than desirable would be required in order to maintain a given current through the cell. This is not a serious drawback with respect to the operation in an individual laboratory-scale cell, because it would be possible either to accept during such initial period a lower rate of production of chlorine and caustic by using a lower current or to take measures to cause the liquid in the cell to be maintained at a temperature lower than it would be if no such measures were taken and a level of current usual for the production of chlorine and caustic at commercial production rates were used. The drawback of an initially high cell voltage, is, however, a serious problem with respect to the use of synthetic-fiber diaphragms of the kind mentioned in the above-mentioned copending application when it comes to the use of such synthetic-fiber diaphragms in cell units of a group of series-connected cells in a cell room, for reasons which will be explained in detail below.

Relatively high cell-voltage during an initial period of operation is a problem, in respect to commercial utilization of synthetic-fiber diaphragms, largely because it is essential to prevent the liquid in the cell diaphragm from boiling. If the liquid in the diaphragm boils, the diaphragm is likely to rupture and become substantially inoperative. A group of series-connected cell units is operated at some current such as 25,000 to 120,000 amperes, i.e., a current density on the order of 130 to 150 amperes per square foot; the current is necessarily the same through each cell unit in the series-connected group. If a given single cell diaphragm has a relatively greater resistance, i.e., a greater cell voltage, there is thus evolved within that particular cell unit a relatively greater amount of heat. This implies that it is necessary to keep the cell voltages of each of the members of the series-connected group relatively at about the same value.

Without the improvement of the present invention, it would be possible to start up an entire series-connected group of cell units provided with new synthetic-fiber diaphragms and operate for an initial period of time with a relatively low amperage, accepting for the first 10 days to 2 weeks of operation a relatively lower rate of production. It would also be possible, later on, when an individual cell unit requires replacement of its diaphragm, to replace it with one which has been operated separately under suitable conditions for a period of approximately 2 weeks, so that its cell-voltage characteristics would not differ too greatly from those of the others in the series-connected group of cell units. It is unavoidable, in the commercial context, that removal of individual cell units of the group will be required, because it is impossible to predict exactly how soon an individual cell unit will require renewal; it is not, moreover feasible to shut down the entire series because one or two of the units require renewal, and it is not desirable to allow an increasing number of individual units which have become unsatisfactory to be taken out of service and not renewed. Thus, there is need for an improvement such as that provided by the present invention.

The most pertinent prior art of which we are aware, apart from the above-mentioned application, is British Pat. No. 1,081,046, which teaches the use for the electrolysis of brine of a diaphragm made of polytetrafluoroethylene and describes, as an additional feature, the use of an inorganic filler material such as barium sulfate, titanium dioxide, or the amphibole or serpentine forms of asbestos. This British patent does not relate to diaphragms made of fluoro-carbon polymers in the form of an entanglement of very fine fibers, such as to produce the desired degree of permeability of the diaphragm; instead, the teachings of the British patent are concerned with the making of synthetic-material diaphragms wherein a different technique is used: polytetrafluorethylene in the form of an aqueous dispersion of sub-micron-sized particles is mixed with a "solid particulate additive", such as starch or calcium carbonate, which is substantially insoluble in the aqueous dispersion medium from which the diaphragm is formed but is capable of being removed from the sheet by treatment with hydrochloric acid or the like to form a diaphragm sheet of the desired porosity. Thus, the British patent does not begin to provide those skilled in the art with a technology based upon the use of a suitable fluoro-carbon polymer in the form of very fine fibers, so as to make it possible to replace asbestos completely and obtain satisfactory service life and operating characteristics; moreover, the British patent, insofar as it teaches the inclusion of inorganic materials in its diaphragms, only teaches the use of this feature for extending the operating life of the diaphragm and better maintaining the permeability of the diaphragm while it is in use, and it gives no indication of the connection between the use of such inorganic materials and the initial improvement in cell-voltage characteristics which the applicants have observed.

SUMMARY OF THE INVENTION

Fiber diaphragms made according to copending application Ser. No. 742,818, filed Nov. 18, 1976, are improved by making a diaphragm containing about preferably about 5 to 80 percent by weight of an inorganic material which is stable in the cell environment and imparts an increased degree of hydrophilicity, such as barium sulfate, barium titanate, or titanium dioxide, the inorganic material being in the form of sub-micron-sized particles. The inorganic material may be mixed with the polychlorotrifluoroethylene or similar synthetic material before it is put into the form of fibers in accordance with a method described in Belgian Pat. No. 795,724, or alternatively, it may be mixed with the slurry from which the diaphragm is deposited, or even provided to the diaphragm after it is deposited. A diaphragm made in accordance with the teachings of the present invention gives, for example, within about 3 to 10 hours after the diaphragm is inserted in a cell unit and the cell unit is operated, a cell voltage of at least 0.4 to 0.8 volt lower than that of a diaphragm which is otherwise similar but does not contain such inorganic material; that is, synthetic-fiber diaphragms of this type, containing the inorganic material, reach a desirably low cell voltage within a few hours, rather than requiring a relatively great length of time, such as 10 days or 2 weeks. This makes it possible to practice a cell-renewal method in which an individual cell unit, contained in a group of series-connected chlor-alkali cell units being operated at 100 to 180 milliamperes per square centimeter (which implies, in the case of a commercial cell, something like 25,000 to 120,000 amperes) and individual cell voltages on the order of 3.4 volts or less, is renewed by providing it with a diaphragm containing inorganic material as indicated above, and as a result, unwanted boiling of the liquid within the individual cell unit and/or the diaphragm is avoided.

DESCRIPTION OF THE PREFERRED EMBODIMENTS

There will be described below the best mode contemplated by the inventors of practicing their invention, and thereafter, there will be discussed the various modifications and equivalents which may be practiced.

This invention is an improvement of the invention disclosed in the copending application Ser. No. 742,818, filed Nov. 18, 1976, and entitled "Chlorotrifluoroethylene Containing Polymer Diaphragm". In the interest of brevity, reference will be made to the above-mentioned application for all the details that are not discussed herein.

It is important to notice that in accordance with the present invention, there are used fibers which are composed importantly of polymers having a chemical composition as defined in the above-mentioned copending application. Thus, the present invention involves the use of fibers of a fluoro-carbon polymer containing an important proportion of polychlorotrifluoroethylene, such that, as described in the above-mentioned copending application, surface plies of substantially greater strength are developed when a diaphragm made of such fibers is subjected to conditions approximating those of use in a commercial chlor-alkali cell; the use of fibers of polytetrafluoroethylene or of the 1:1 copolymer of chlorotrifluorethylene and ethylene, which do not develop such surface plies, is outside the scope of the present invention.

In accordance with a best mode of practicing the invention, there is first produced a composition of matter consisting essentially of 70 weight percent of polychlorotrifluoroethylene and 30 weight percent of pigment-grade (sub-micron-sized) titanium dioxide.

Then, such material is put into the form of fibers having a cross-section on the order of 1 micron by 4 microns and a length of approximately 0.25 to 0.5 millimeters, in accordance with a modification of a process which is adequately described in Belgian Pat. No. 795,724. The surface area of such fibers is 5 to 20 square meters per gram, as measured by nitrogen adsorption. There is thus produced a material which is, in effect, water-soaked fiber bundles, containing 80 to 90 percent by weight of water, made by draining the output of the process conducted according to the above-mentioned Belgian patent on a perforated moving bed.

Then, the material thus obtained is mixed with other material to form the composition of matter suitable for the manufacture of a synthetic-fiber diaphragm made in accordance with the present invention.

Such a composition of matter, in accordance with the best mode of practicing the present invention, consists essentially of about 12 or 13 grams per liter of fibers of the kind indicated above, and about 2 grams per liter of a fluorine-containing surfactant dissolved in water, such as the surfactant sold by 3M Company under the name FLUORAD "FC-170" (which is a proprietary mixture of fluorinated alkyl polyoxyethylene alcohols containing 38.3% carbon, 31.3% fluorine, and 5.3% hydrogen by weight). It is possible to take the as-received water-containing fibers, conduct a water-content determination, and then make a composition of matter as defined above.

Next, the composition of matter thus obtained is, as taught in the above-mentioned application, used to form a two-layered diaphragm by drawing the above-described composition through a cathode screen at a ratio of 8 to 10 cubic centimeters of composition per square centimeter of screen area. This may be done by the use of a schedule such as the following: For the first coat, 25 millimeters of mercury vacuum for 2 minutes, 50 millimeters of mercury vacuum for 3 minutes, then 100 millimeters of vacuum for 3 minutes, and then a relatively high vacuum of 610 to 710 millimeters of mercury vacuum for a period of 20 minutes.

The preferred temperature range for deposition of the diaphragm is 60° C. to 100° C.; that is the slurry composition is heated from room temperature to a temperature in the range prior to diaphragm deposition.

While useful diaphragms can be produced from a slurry deposited at room temperature, diaphragms prepared by deposition at the higher temperature will have a significantly lower permeability and improved performance as a cell separator.

This produces upon the cathode member a diaphragm which has a gross thickness on the order of 2 to 3 millimeters.

The next step is to subjet the diaphragm, deposited upon a cathode, to drying. We use an oven at 110° C. for a period of several hours, such as 8 hours.

Thereafter, the cathode member, having the diaphragm deposited thereon, is put into a chlor-alkali cell and used. In a preferred aspect of the invention, a diaphragm which has been deposited upon a cathode screen as indicated above is installed in a given one of a plurality of cell units which have been connected in series, such that the current density through each one of the members of the cell units connected in the series is the same, being on the order of 100 to 180 milliamperes per square centimeter. It is true, moreover, in respect to most cell rooms used for the operation of chlor-alkali cells for the electrolysis of brine into chlorine and caustic, that the voltage change within an individual one cell unit in a series of such cells is less than 3.4 volts, and it is also true that, unless the present invention is practiced, the cell-voltage difference, in an individual one of the group of cells connected in the series, would ordinarily be, at least during the first 100 or 200 hours of the operation of a new diaphragm made in accordance with the teachings of the above-mentioned copending application, on the order of 4.6 volts or greater, i.e., more than 1.0 volt and usually more than 1.2 volts higher than the cell-voltage difference which would be desired. In accordance with the present invention, however, any voltage difference so great occurs only for a relatively very short time, such as the first 0.5 to 3 hours, namely, at a time when the liquid in the cell is very substantially below the temperature which is considered optimal and maximal. It usually requires, after an individual cell is connected into others of its group, about 2 or 3 hours before the temperature of the liquid within the cell has been raised to that of the others within the group of series-connected cell units, namely, a temperature on the order of 60° to 95° C. When a diaphragm in accordance with the present invention is used, it is true, moreover, that by that time, the cell voltage of an individual cell, made in accordance with the present invention will have decreased to a value on the order of 3.6 volts or less, such that it is unlikely that the liquid in the interior of a cell provided with a diaphragm made in accordance with the present invention will reach a boiling temperature. In contrast, however, it is true that an individual cell in a series of such cells, provided with a diaphragm made only in accordance with the invention of the above-mentioned copending application, will exhibit an individual cell voltage on the order of 4.6 volts or greater, and more usually 5 or 6 volts, such that it would be quite likely that, unless other particular measures were taken, such as use of the diaphragm in an environment of relatively hot brine for a period such as approximately 2 weeks were practiced, or unless the individual cell unit had practiced, with respect to it, particular measures which would otherwise dispose of the additional heat which would ordinarily be generated, the liquid within the cell, and in particular, in the diaphragm, would be likely to boil, with consequences which could not be tolerated. Even refrigerating the cell as a whole is not helpful, because the heat is generated locally where the resistance is, i.e., within the diaphragm. Using a greater flow through the diaphragm will dissipate the heat to some extent, but this gives a more dilute product. With diaphragms made in accordance with the present invention, however, the cell voltage decreases within about 3 to 5 hours of operation, i.e., long before the time that the liquid within the cell is likely to boil, to a value such that boiling of the liquid within the individual cell is not likely to occur. Thus, there are obtained not only all of the benefits indicated within the above-mentioned copending application, making it possible to substitute a synthetic-fiber diaphragm for the asbestos diaphragms hitherto used, but also there is overcome a further problem with respect to the operation of chlor-alkali cells containing such diaphragms during the first approximately 10 days to 2 weeks of the service life thereof.

It is believed that the use of the inorganic material yields another benefit, one which persists through the life of the diaphragm. The small particles are thought to serve to block some of the small pores which might otherwise remain open in the diaphragm. Such small pores, though they do not provide much opportunity for liquid to percolate through the diaphragm, might if unobstructed provide, in effect, a small column of stagnant liquid through which unwanted backmigration of hydroxyl ions may occur, detracting from the performance of the cell unit.

The best mode of practicing the invention, as described above, is subject, in accordance with the teachings hereinbelow, to various modifications and equivalents.

In respect to the composition of the polymer which is to be used, the principal consideration is that there shall be used a polymer which does develop, within some hours of use, a pair of plies of material of substantially different composition which serves to increase the strength and the service life involved. At least in accordance with the present knowledge, it is necessary to define the polymers used as being those which contain at least 80% of chlorotrifluoroethylene units and up to 20% of units of other compatible $C_2$ to $C_4$ unsaturated monomers, especially fluorine-containing $C_2$ or $C_3$ unsaturated monomers.

As have already been indicated above, it is not necessary that the inorganic hydrophilic material be provided in the precise manner indicated above, i.e., by being combined with the polymer before the fibers are formed. Adequate results have also been obtained by providing the inorganic material together with the other chemical constituents of the composition or slurry from which the diaphragm is deposited upon the cathode screen, and adequate results have also been obtained, after a diaphragm has been deposited upon a cathode screen, by adding the inorganic material, usually but not necessarily in admixture with more of the suitable fluorocarbon polymer material, at that time. The overall importance of obtaining a diaphragm having proper permeability characteristics is adequately indicated in the above-mentioned copending application Ser. No. 742,818. So long as there is produced a diaphragm which both exhibits adequate permeability characteristics and contains, before it is set to use within an individual cell unit, a proportion of hydrophilic inorganic finely divided material so that it exhibits the desired low cell-voltage characteristics during an early part of its period of use in a chlor-alkali cell, the present invention, at least in its broader aspects, is being practiced. Thus, so far as the present invention in its broadest aspects is concerned, it does not make any difference whether the inorganic material is incorporated by virtue of being admixed with the fluorocarbon polymer before the fibers are formed, as indicated in the above-described best mode of practicing the invention, or is added to the slurry or composition from which the fibers are deposited upon the cathode member to form a diaphragm, or is separately deposited upon and within the diaphragm from a slurry or suspension of sub-micron-sized particles of hydrophilic, inorganic material, even after the diaphragm has been formed upon the cathode member.

The proportion of inorganic material which is to be used may be varied within relatively wide limits, ranging from 5 to 80 percent by weight, based upon the polymer of the fibers and more usually and preferably being on the order of 20 to 40 percent by weight. It is considered essential that the hydrophilic inorganic material be present in the form of sub-micron-sized particles. No particular greater degree of fineness is required, but consideration should be given to using a proportion of inorganic material which, considering its fineness and the characteristics of the polymer fibers employed, yields a diaphragm of suitable permeability.

The invention is not strictly limited to having the diaphragm formed upon a cathode-screen member. Those skilled in the art will appreciate that it is possible, in some circumstances, to use, in effect, a paper-making machine, and thus to form a web which may, if necessary, be cut to size and suitably positioned around and secured to a cathode member and then inserted into the cell for use in the electrolysis of brine. Whether the inorganic, hydrophilic material is included in the fibers made from the polymer, or included in the fibers as deposited during the "paper-making" operation because of being an ingredient in the composition used for that operation, or applied to the "paper" in still another way, after it is formed, is a matter of choice; nevertheless, it will ordinarily be preferable to form the diaphragm in place upon the cathode screen, and when this is not done, it will ordinarily be preferable to include the inorganic material with the polymer, to save a mixing step, but any of the various practices or procedures indicated above must be considered within the scope of the present invention.

Various media may be used to comprise the bulk of the liquid containing the polymer in fiber form from which the synthetic-fiber diaphragm may be deposited upon a cathode screen. For example, water, an equivolume mixture of water and acetone, or a dilute aqueous sodium hydroxide solution containing approximately 70 to 170 grams per liter of sodium hydroxide, corresponding to the dilute sodium hydroxide product of the cell, may be used, as can various other similar media which will suggest themselves to those skilled in the art.

Such matters as the precise dimensions of the fibers used in constructing the diaphragms of the invention, the concentration of the composition from which the diaphragm is deposited, and the quantity of composition solution per unit of diaphragm, i.e., the thickness of the diaphragm produced, may also, of course within limits, be varied, as those skilled in the art will appreciate. An important consideration is the permeability of the diaphragm which is produced, and in this regard, attention is to be paid to the teachings of the above-mentioned copending application Ser. No. 742,818, filed Nov. 18, 1976. A diaphragm having a c.g.s. permeability coefficient of 0.1 to $5.0 \times 10^{-9}$ square centimeters, on the basis indicated in the above-mentioned copending application, is ordinarily required. The best mode of practicing the present invention is to achieve such permeability values by control of fiber dimensions and dispersion of said fiber in the dispersion medium.

While it is possible to influence the diaphragm permeability by an increase in diaphragm thickness, this will cause the diaphragm's electrical resistance to increase, and consequently an energy penalty will be exacted. Moreover, the proportion of inorganic material used may influence importantly the permeability coefficient obtained, lower permeabilities being obtained with the use of relatively greater amounts of inorganic material, and once again, this factor may be permitted to cooperate to yield a diaphragm giving satisfactory performance characteristics and satisfactory permeability.

It is also considered within the scope of the invention that the finely divided inorganic material be provided to the diaphragm by supplying it with the brine fed to the cell; although results somewhat satisfactory may be obtained in this way, it is desirable, in accordance with the invention, to obtain a diaphragm which contains the inorganic material in such a form that it is effectively present at or near both of the outside surfaces of the diaphragm.

As the sub-micron-sized hydrophilic inorganic material which is used in the practice of the present invention, various materials may be used in place of the pigment-grade titanium dioxide mentioned above as constituting part of the best mode known to the inventors of practicing the invention. Thus, there may also be used not only barium sulfate but also potassium titanate, as well as calcium sulfate, sodium titanate; barium titanate; or the carbides, borides, nitrides, oxides or silicates of hafnium, zirconium, or yttrium.

The use of fluorine-containing surfactant material, although indicated in the above-described best mode of practicing the invention, is not to be considered absolutely necessary. Various other surfactant materials of essentially similar nature will suggest themselves to persons or ordinary skill in the art as possible substitutes. Omitting such a surface-active material altogether is, in some instances, possible.

The above-mentioned copending application Ser. No. 742,818, filed Nov. 18, 1976, has indicated various possibilities with respect to how the composition from the diaphragm is made is to be maintained in a properly suspended condition during the diaphragm-deposition operation, including the use of air sparging, the use of mechanical agitators, and the use of a recirculated mixture. The same applies, of course, to the present invention.

The step of oven-drying the diaphragm before inserting it into a cell, although preferable, is not to be considered absolutely necessary.

Although in the description of the best mode of practicing the invention, there has not been included a practice of subjecting the diaphragm, after it is formed and brought into juxtaposition with the cathode member, to a treatment outside the cell, whereby within some relatively short time, such as 3 to 10 hours, the cell-voltage characteristics of the diaphragm will be modified, so that the diaphragm will, immediately upon being inserted into the cell unit, give satisfactory performance with respect to the cell-voltage characteristics, such a practice is also within the scope of this invention. Those skilled in the art will understand, from the foregoing statement, how such a practice may be adopted. In particular, it is possible to use a cathode member having a diaphragm in accordance with the invention deposited thereon in an individual chlor-alkali cell having cell-liquid temperatures on the order of 60° to 95° C. for some period of time such as 3 to 10 hours, thereby producing a cathode member having a diaphragm deposited thereon which will more surely yield satisfactory cell-voltage characteristics immediately upon being inserted into a cell in its renewal.

The invention described above is further illustrated by the following specific examples, which are to be taken as illustrative and not in a limiting sense.

EXAMPLE 1

A diaphragm, designated in our records as "6184-D", was prepared by drawing, through a conventional steel cathode screen at a rate of 480 milliliters of slurry per 100 square centimeters of screen area, an aqueous slurry containing 12.4 grams per liter of very fine fibers of a copolymer of chlorotrifluoroethylene and vinylidene fluoride (25 units of chlorotrifluoroethylene per 1 unit of vinylidene fluoride). The slurry temperature was 25° C.

A second layer was then applied, by drawing through a screen having the above-indicated first layer upon it, an equal volume of a slurry substantially similar, except that it also contained 50 grams per liter of pigment-grade titania (0.25 micron particle size). The diaphragm was dried. This yielded a diaphragm with a thickness of 2.7 millimeters and a density of 13.9 grams per 100 square centimeters. The diaphragm-covered cathode was installed in a test cell which had an electrode spacing of 6.4 millimeters.

A flow of brine was established, and electrical current was applied at a current density of 160 milliamperes per square centimeter. The following data were taken:

| Hours of Operation | Temp., ° C | Cell Voltage |
|---|---|---|
| 0.08 | 25 | 4.02 |
| 0.5 | 25 | 4.1 |
| 2.0 | 43 | 3.86 |
| 2.5 | 45 | 3.70 |
| 3.0 | 45 | 3.63 |
| 3.5 | 47 | 3.60 |
| 4.0 | 48 | 3.58 |
| 5.5 | 49 | 3.56 |

In comparison, a similar diaphragm, prepared without titania, required 288 hours to obtain a similar reduction in cell voltage.

Operation of the cell was continued at 160 milliamperes per square centimeter, with results indicated in the following table.

| Day of Operation | Cell Voltage | Cell Temp., ° C | NaOH Concentration, g./l. | $NaClO_3$ Concentration, g./l. |
|---|---|---|---|---|
| 20 | 3.04 | 73 | 109 | 0.15 |
| 30 | 3.04 | 75 | 113 | 0.25 |
| 53 | 3.06 | 76 | 129 | 0.50 |
| 75 | 3.05 | 80 | 114 | 0.45 |
| 108 | 3.11 | 74 | 112 | 0.13 |

EXAMPLE 2

A diaphragm, designated in our records as "6184-B", was prepared by drawing successive quantities of aqueous slurry containing 12.4 grams per liter of fibers of the 25:1 copolymer of chlorotrifluorethylene and vinylidene fluoride through a steel cathode screen at a rate of 480 milliliters of slurry per 100 square centimeters of cathode screen, to form a two-layered diaphragm structure. The temperature was 25° C.

The diaphragm was subjected for 5 minutes to a vacuum (51 centimeters of mercury below atmospheric pressure). Then, an aqueous suspension of titania particles, as described above, at a concentration of 50 grams per liter, was drawn through the diaphragm, at a rate of 480 milliliters per 100 square centimeters of diaphragm. The diaphragm was again subjected to a vacuum of 51 centimeters of mercury below atmospheric pressure for an additional 15 minutes.

After being dried at 110° C., the diaphragm was tested for permeability to nitrogen gas, yielding a coefficient of $0.77 \times 10^{-9}$ square centimeters, on the basis disclosed in the above-mentioned application Ser. No. 742,818, filed Nov. 18, 1976.

The diaphragm was installed in a chlor-alkali cell, as described in Example 1, and operated at a current density of 160 milliamperes per square centimeters.

A similar early reduction in cell voltage, essentially complete in about 4 hours, was also observed.

The following data were also taken with respect to the continued operation of the cell.

| Day of Operation | Cell Voltage | Cell Temp., ° C | NaOH Concentration, g./l. | $NaClO_3$ Concentration, g./l. |
|---|---|---|---|---|
| 21 | 3.27 | 76 | 126 | 0.30 |
| 35 | 3.16 | 76 | 123 | <0.10 |
| 50 | 3.14 | 75 | 136 | 0.37 |
| 97 | 3.18 | 75 | 150 | 0.5 |
| 99 | 3.16 | 75 | 151 | 0.29 |

While we have shown and described herein certain embodiments of our invention, we intend to cover as well any change or modification therein which may be made without departing from its spirit and scope.

The embodiments of the invention in which an exclusive property or privilege is claimed are defined as follows:

1. In a diaphragm for use in a chlor-alkali cell, said diaphragm being composed of an entanglement of fibers of a fluorine-containing addition polymer selected from the group consisting of the homopolymers of chlorotrifluorethylene and copolymers of chlorotrifluoroethylene with at least one compatible unsaturated $C_2$ to $C_4$ monomer, units of chlorotrifluoroethylene accounting for at least 80 percent of the monomeric units of said copolymer which exhibits the property of generating a pair of surface plies of increases strength when subjected to cell-environment conditions for a period of about 2 weeks, said fibers being about 4 microns or less in one cross-sectional dimension, and said diaphragm having a c.g.s. permeability of 0.1 to $5 \times 10^{-9}$ square centimeters, the improvement which consists in providing to said diaphragm about 5 to 80 percent by weight of a hydrophilic inorganic material stable in the cell environment, said hydrophilic material being in the form of sub-micron-sized particles, whereby the cell-voltage characteristics of the cell unit containing such a diaphragm are improved during the initial period of operation of such cell unit.

2. An improvement according to claim 1, wherein said inorganic material is selected from the group consisting of titanium dioxide, barium sulfate, and potassium titanate.

3. An improvement according to claim 2 wherein said material is titanium dioxide.

4. An improvement according to claim 1, wherein the inorganic material is provided by being mixed with the polymer of which such fibers are made before the fibers are formed.

5. An improvement according to claim 1, wherein the inorganic materials are provided by being mixed with fibers in a composition used for the deposition of said diaphragm upon a cathode member.

* * * * *